US011174593B2

(12) United States Patent
Mikkonen et al.

(10) Patent No.: US 11,174,593 B2
(45) Date of Patent: Nov. 16, 2021

(54) BASE FABRIC, PRESS FELT AND METHOD OF FORMING BASE FABRIC WITH SEAM

(71) Applicant: Valmet Technologies Oy, Espoo (FI)

(72) Inventors: Kati Mikkonen, Tampere (FI); Jorma Naamanka, Ylojarvi (FI)

(73) Assignee: VALMET TECHNOLOGIES OY, Espoo (FI)

( * ) Notice: Subject to any disclaimer, the term of this patent is extended or adjusted under 35 U.S.C. 154(b) by 637 days.

(21) Appl. No.: 16/074,214

(22) PCT Filed: Jan. 25, 2017

(86) PCT No.: PCT/FI2017/050038

§ 371 (c)(1),
(2) Date: Jul. 31, 2018

(87) PCT Pub. No.: WO2017/134339

PCT Pub. Date: Aug. 10, 2017

(65) Prior Publication Data

US 2021/0140106 A1 May 13, 2021

(30) Foreign Application Priority Data

Feb. 1, 2016 (FI) ..... 20165065

(51) Int. Cl.
*D21F 7/08* (2006.01)
*D21F 7/10* (2006.01)
*D03D 3/04* (2006.01)

(52) U.S. Cl.
CPC ..... *D21F 7/083* (2013.01); *D21F 7/10* (2013.01); *D03D 3/04* (2013.01)

(58) Field of Classification Search
CPC .. D21F 7/083; D21F 7/10; D21F 7/08; D03D 3/04
See application file for complete search history.

(56) References Cited

U.S. PATENT DOCUMENTS

| | | | | |
|---|---|---|---|---|
| 5,110,672 | A | 5/1992 | Zehle et al. | |
| 5,458,161 | A | 10/1995 | Scarfe | |
| 5,939,176 | A * | 8/1999 | Yook | B32B 5/26 428/193 |
| 6,267,150 | B1 * | 7/2001 | Herring | D21F 1/0054 139/383 AA |
| 6,880,583 | B2 * | 4/2005 | Billings | D21F 1/0054 139/383 AA |
| 8,353,252 | B1 | 1/2013 | Klaschka et al. | |
| 2008/0105323 | A1 * | 5/2008 | Hay | D21F 1/0045 139/383 A |
| 2009/0090425 | A1 | 4/2009 | Hawes et al. | |

FOREIGN PATENT DOCUMENTS

| | | | |
|---|---|---|---|
| EP | 1338697 | 8/2003 | |
| JP | 3408360 | 5/2003 | |
| WO | WO 89/12717 | 12/1989 | |
| WO | WO-8912717 A1 * | 12/1989 | D21F 1/0054 |
| WO | WO 9421847 | 9/1994 | |

* cited by examiner

*Primary Examiner* — Eric Hug
*Assistant Examiner* — Matthew M Eslami
(74) *Attorney, Agent, or Firm* — Leason Ellis LLP

(57) ABSTRACT

The invention relates to a base fabric of a press felt. The base fabric comprises end regions which are provided with seam loops (4). The seam loops are slanted. Further, the invention relates to a press felt and a method of forming the same.

8 Claims, 4 Drawing Sheets

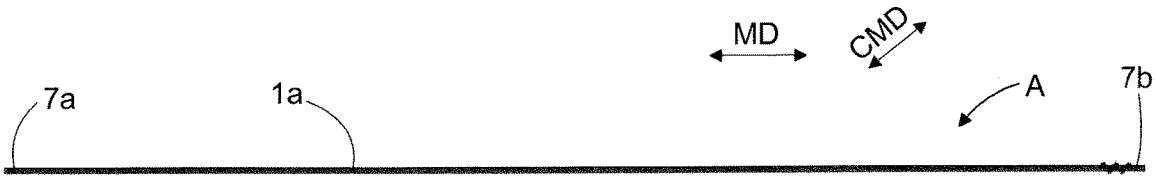
FIG. 3a
FIG. 3b
FIG. 3c
FIG. 3d
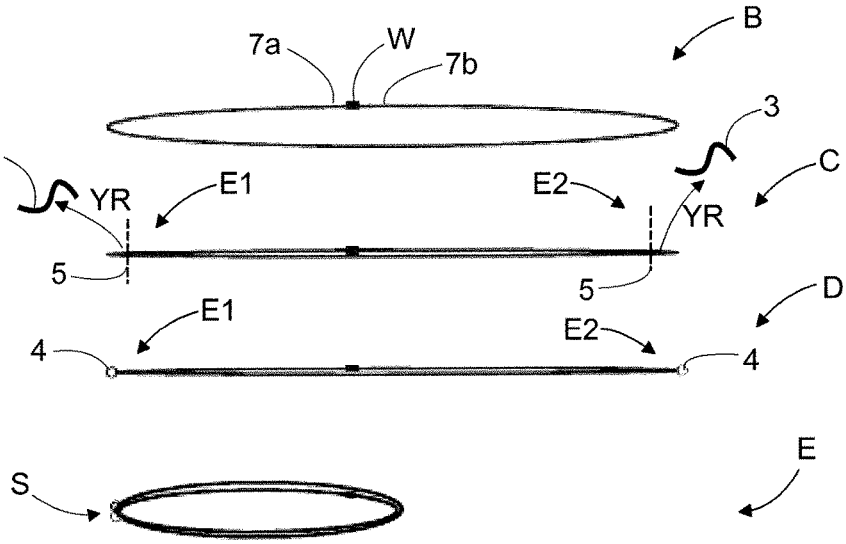
FIG. 3e
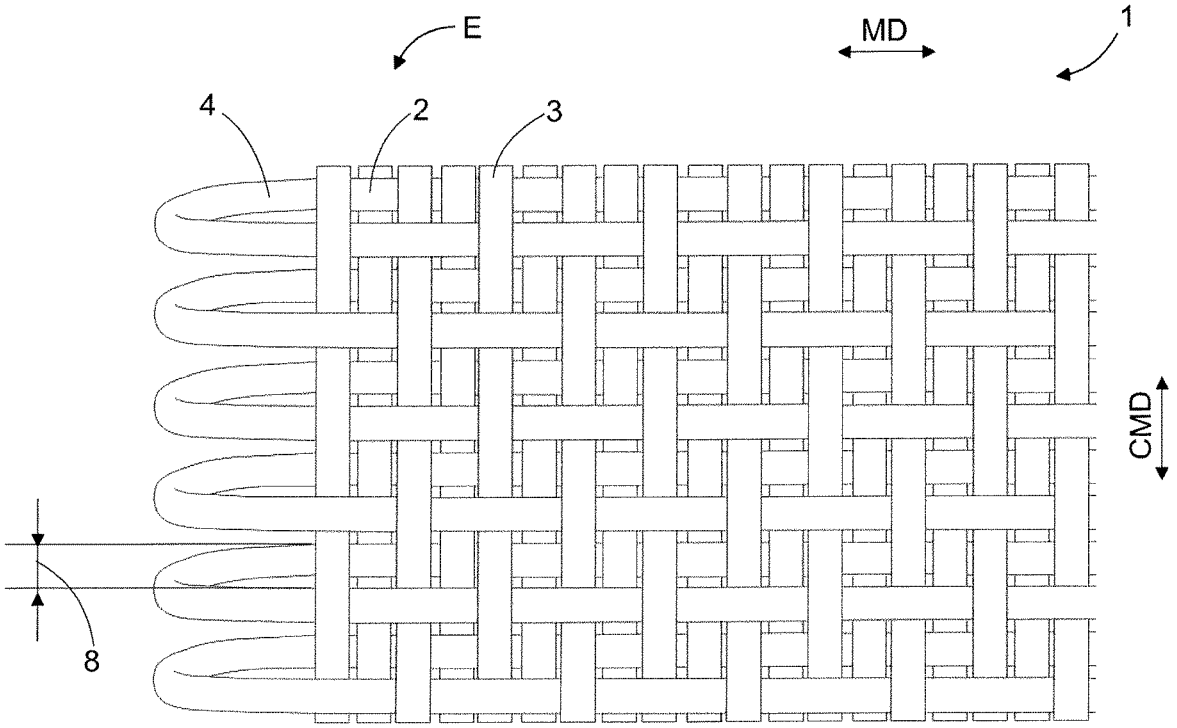
FIG. 4

BASE FABRIC, PRESS FELT AND METHOD OF FORMING BASE FABRIC WITH SEAM

CROSS-REFERENCE TO RELATED PATENT APPLICATIONS

This application is a U.S. National Phase Application under 35 U.S.C. § 371 of International Patent Application No. PCT/FI2017/050038, filed Jan. 25, 2017, which claims the priority of Finnish Application No. 20165065, filed Feb. 1, 2016, each of which is incorporated by reference as if expressly set forth in its entirety herein.

BACKGROUND OF THE INVENTION

The invention relates to a base fabric of a press felt, which press felt is designed to be used on a press section of a paper machine. The base fabric comprises several machine direction yarns i.e. warp yarns, and several cross machine direction yarns i.e. weft yarns. The base fabric further comprises two cross machine direction end regions, which are provided with seam loops formed of the machine direction yarns.

The invention relates also to a press felt and to a method of forming a base fabric with a seam.

The field of the invention is defined more specifically in preambles of the independent claims.

Press felts are used on press sections of paper machines. The press felt guides a paper web through the press section and also receives water removed from the paper web during pressing. The press felt comprises a base fabric and at least one batt fibre layer attached at least on one side surface of the base fabric. In order to facilitate mounting the press felt may be provided with a transverse seam. Known solutions for forming the base fabric and manufacturing the press felt have shown to be difficult to manufacture and may also contain some disadvantages especially at the seam area.

BRIEF DESCRIPTION OF THE INVENTION

An object of the invention is to provide a novel and improved base fabric, press felt and method of forming the same.

The base fabric of the invention is characterized by features disclosed in a first independent product claim.

The press felt of the invention is characterized by features disclosed in a second independent product claim.

The method of the invention is characterized by features disclosed in an independent method claim.

An idea of the disclosed solution is that a base fabric of a press felt is a flat formed structure comprising several machine direction yarns and several cross machine direction yarns. The base fabric also comprises a first end region and a second end region. At the end regions the fabric is folded and one or more adjacent cross machine direction yarns are removed. Thus, the machine directions yarns, which are also folded at both end regions, form seam loops. This way, both end regions are provided with connectable seam loops. The seam loops may be interdigitated and may serve as connecting members together with a seam yarn or corresponding element. The base fabric further comprises transverse bonding sections at proximity of the end regions in order to bond the folded fabric sections together. Furthermore, the seam loops are slanted whereby the folded machine direction yarns forming the seam loops are without alignment at the end regions. In other words, the slanting means non-alignment.

An advantage of the disclosed solution is that properties of the seam area may be adjusted by adjusting the slanting of the seam loops.

According to an embodiment, the base fabric is a woven structure. Thus, the base fabric is flat woven by means of a weaving machine and utilizing flat weaving technique.

According to an embodiment, after the base fabric has been folded, 1 to 5 cross machine direction yarns are removed at the end regions. The number of the removed CMD-yarns may be determined on the basis of the desired size of the seam loops.

According to an embodiment, angle of slant of the seam loops relative to surface sides of the base fabric is the same for all of the seam loops at the end region.

According to an embodiment, the end regions of the base fabric may comprises at least two different zones in the transverse direction. The zones are provided with slanted seam loops which differ from each other regarding their slanting direction, and additionally or alternatively, angle of slant of the seam loops may be different at the zones of the base fabric. This way, the base fabric may, for example, comprise a first zone and a second zone with limited widths at the transverse edge areas and a central third zone between the two edge zones. An advantage of this solution is that properties of the zone areas may be adjusted in accordance with the need.

According to an embodiment, the slanted seam loops have nonalignment and amount of the slanting or non-alignment corresponds to at least half of the dimension or transverse width of the MD-yarns forming the seam loops. This means that, when seen from the surface side of the base fabric each slanted seam loop has an angle of slant amount of which is at least half of an outer dimension of the machine direction yarn forming the seam loop. Further, when maximum angle of slant is utilized, then adjacent seam loops may be in a partially overlapping relationship. Typically, the angle of slant corresponds to transverse width of the MD-yarns. This way, the seam loops are always clearly at an angle relative to surfaces of the fabric and imaginary planes defined by lateral surfaces of the seam loops are not perpendicular relative to surfaces of the base fabric.

According to an embodiment, the seam loops have the same slanting direction and angle of slant. Further, the seam loops may be forced to a desired position by means of a template piece. By means of the template piece, the slanting of the seam loops may be controlled properly and the slanting angle may be accurately determined.

According to an embodiment, the adjacent seam loops form together a transverse directed seam channel.

According to an embodiment, the machine direction yarns are twisted relative to their longitudinal axis at the end regions in order to allow formation of the slanted seam loops. The twisting occurs when the seam loops are forced to the desired angular position by means of template piece or corresponding device.

According to an embodiment, adjacent seam loops are partly overlapping at the end region when seen from an outer surface side of the base fabric. This embodiment discloses maximum slanting of the seam loops. Let it be mentioned that when minimum slanting is utilized then the seam loop is partly overlapping with itself, but is still not totally aligned.

According to an embodiment, cover factor of the machine direction yarns at the end regions is greater than at a section between the end regions due to the slanted seam loops. Thanks to the slanted seam loops, air permeability of the seam area may be decreased relative to a seam area furnished with aligned seam loops. This also decreases seam area marking.

According to an embodiment, the flat woven base fabric has a single layer structure. Thus, the base fabric has two layer structure after being folded. Manufacture of the single layer base fabric is easy, fast and cost effective relative to manufacture of more complicated fabric structures.

According to an embodiment, the bonding sections comprise stiches for bonding the folded fabrics to each other. The bonding keeps the fabric layers together and facilitates further manufacturing steps of the press felt. If the batt fibre layer is attached by needling, then the fabric layers are further attached to each other by means of the needled batt fibres.

According to an embodiment, the folded fabric sections are bonded together at the bonding sections by means of ultrasonic welding. Thus, the bonding sections comprise one or more ultrasonic welding seams.

According to an embodiment, the folded fabric sections are bonded together at the bonding sections by means of adhesive. Let it be mentioned that the bonding may be executed by utilizing two or more of the bonding techniques mentioned in this patent application.

According to an embodiment, the seam loops are forced to the desired slanted position and distance from each other by means of at least one template piece. The template piece comprises guiding surfaces provided with desired angles. The template piece or element may be made especially for this special purpose.

According to an embodiment, at least the end regions of the base fabric are heat treated for stabilizing the seam loops to maintain their slanted position after being forced to slanted orientation by means of a template piece or device.

According to an embodiment, the seam loops are being held by means of a template piece until the bonding and the heat treatment are being properly executed.

According to an embodiment, manufacturing process of the base fabric comprises forcing the seam loops to a desired position by means of a template piece, which is made by means of an additive manufacturing technology. Thus, the template piece may be made of polymeric or other suitable material utilizing 3D-printing.

According to an embodiment, manufacturing process of the base fabric allows a predetermined misalignment between the superposed fabrics when executing the folding.

According to an embodiment, during the manufacture of the base fabric a seam yarn is arranged inside a seam channel formed by adjacent seam loops. Size of the used seam yarn may determine size of the seam loops and number of removed transverse yarns.

According to an embodiment, weaving pattern and structure of the flat woven base fabric may be designed freely. Any suitable weaving pattern and structure suitable for the purpose may be selected.

According to an embodiment, the yarns may be any suitable yarns, such as monofilament yarns, multifilament yarns, ply yarns, spun yarns, or their combination.

The above disclosed embodiments and features may be combined in order to form suitable solutions provided with necessary features.

BRIEF DESCRIPTION OF THE FIGURES

Some embodiments are described in more detail in the accompanying drawings, in which FIGS. 3*a*-3*e* are schematic views showing manufacturing steps of the press fabric, FIG. 4 is a schematic top view of a part of an end region of a base fabric provided with slanted seam loops.

For the sake of clarity, the figures show some embodiments of the disclosed solution in a simplified manner. In the figures, like reference numerals identify like elements.

DETAILED DESCRIPTION OF SOME EMBODIMENTS

Figure 1:
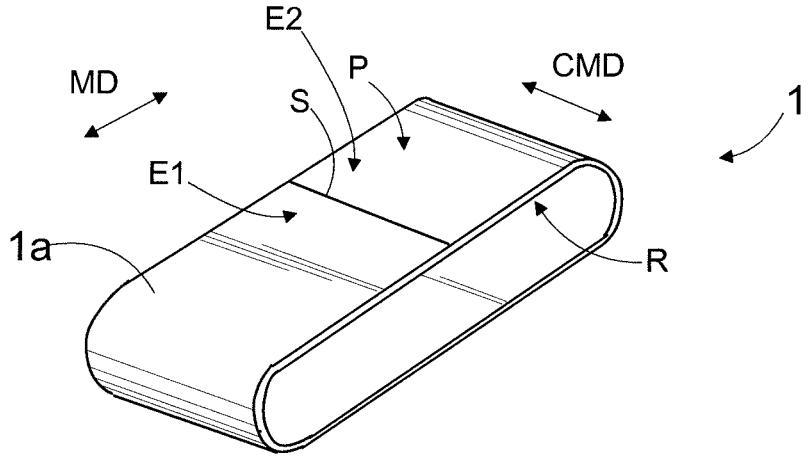
FIG. 1 is a schematic perspective view of a press felt provided with a connectable seam and having a shape of an endless loop.
Figure 2:
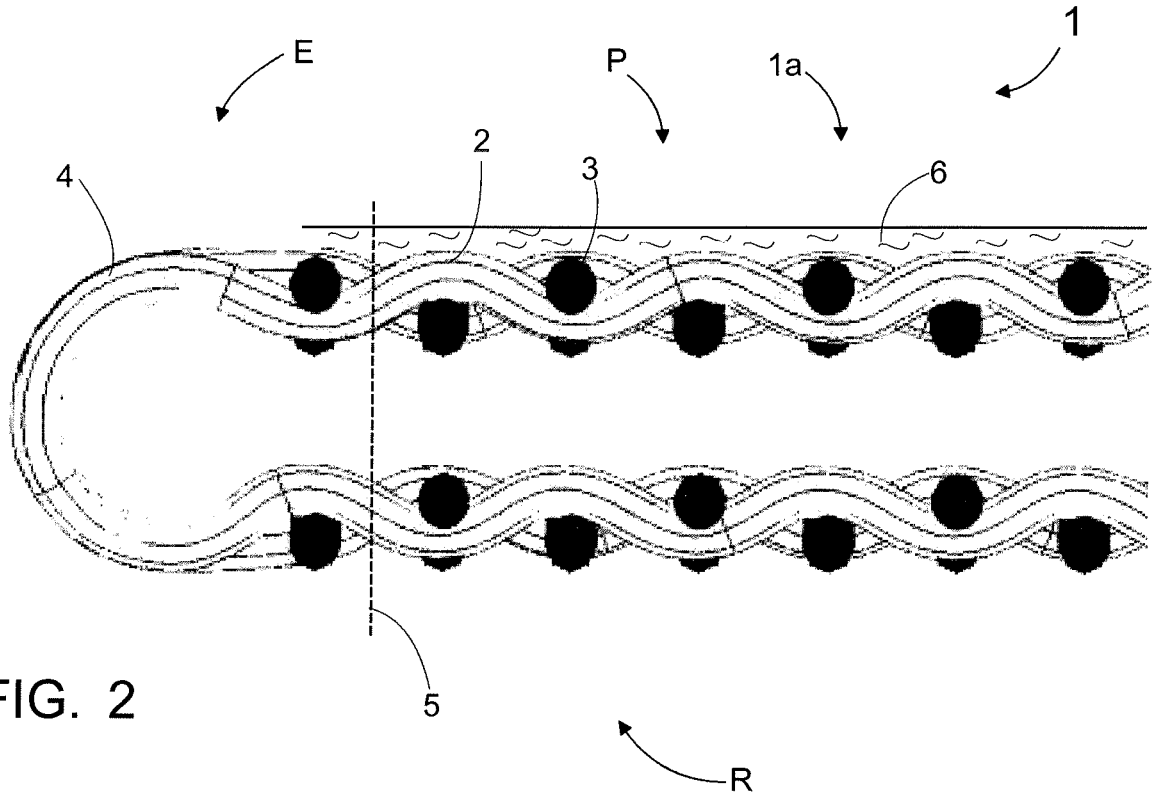
FIG. 2 is a schematic side view of an end region of a press felt seen in the cross machine direction.

FIGS. 1 and 2 show some basic features of a feasible press felt 1. The press felt 1 may comprise a woven base fabric 1*a* comprising machine direction yarns 2 and cross machine direction yarns 3, which are crossing each other. The base fabric 1*a* may be flat woven. End regions E1 and E2 of the press felt 1 may be connected to each other for forming a seam S when installed on a press section of a paper machine. The press felt 1 is configured to run in the machine direction MD. The press fabric 1 comprises a paper side surface P against which a paper web to be dried is arranged on the press section. An opposite side is a roll side surface R which is against rolls and other machine elements of the paper machine.

The seam S comprises interdigitated seam loops at both end regions E1 and E2. Principle of the seam loops 4 is shown in FIG. 2. The seam loops 4 are formed of machine direction yarns 2 of the base fabric 1*a*. The seam loops 4 are formed by folding a flat woven base fabric 1*a* against itself where after double layer structure is generated and the machine direction yarns 2 are also folded so that they form the seam loops 4. The layers of the base fabric are connected to each other by means of at least one bond 5.

After the base fabric 1*a* is properly formed and provided with needed means for the seaming, the base fabric 1*a* is further processed by furnishing it with one or more batt fibre layers 6. Typically, at least the paper side surface P is provided with batt fibre. The batt fibre 6 may be attached in a needling machine to the base fabric 1*a*.

FIGS. 3*a*-3*e* show manufacturing steps A-E of the press felt 1. At first, in a step A a flat base fabric blank is formed by utilizing flat weaving technology, or alternatively, is formed by winding, for example. The flat base fabric 1*a* has ends 7*a* and 7*b*, which are connected to each other in a step B. The connection may be executed by welding technique, such as ultrasonic welding. Then, a welding seam W is formed. Next, the base fabric 1*a* is folded against itself and one or more cross machine direction yarns 3 are removed YR from the formed end regions E1 and E2 in a step C. The step C further comprises bonding the folded structures at the end regions E1 and E2 together by means of bonds 5.

FIG. 3*d* discloses a step D comprising manipulation of the formed seam loops 4 by means of a template piece or any other external means so that the seam loops 4 are directed in a desired manner. In FIG. 3*e* the ends of the base fabric 1*a* are connected to each other at a seam S. Finally, one or more batt fibre layers are attached to one or both outer surfaces of the base fabric.

FIG. 4 shows that the seam loops 4 are slanted so that when seen above the seam loops 4 do not align with itself but instead their edge surfaces are on different planes, as it is indicated in FIG. 4 by means of reference numeral 8.

Figure 5:
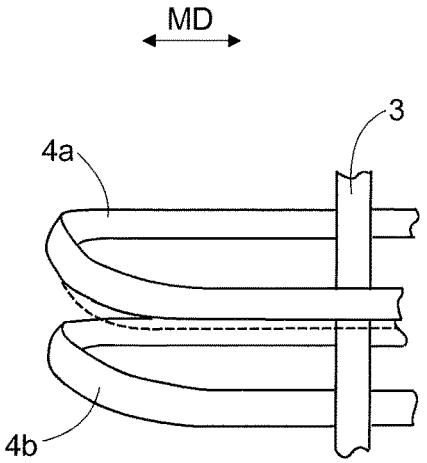
FIGS. 5 and 6 are schematic views showing some feasible slanting designs of seam loops.

FIG. 5 discloses that adjacent seam loops 4*a* and 4*b* may be slanted so that their edge surfaces are against each other. At maximum, the adjacent seam loops may be slanted so that they are partly overlapping, which situation is demonstrated by means of broken lines.

Figure 6:
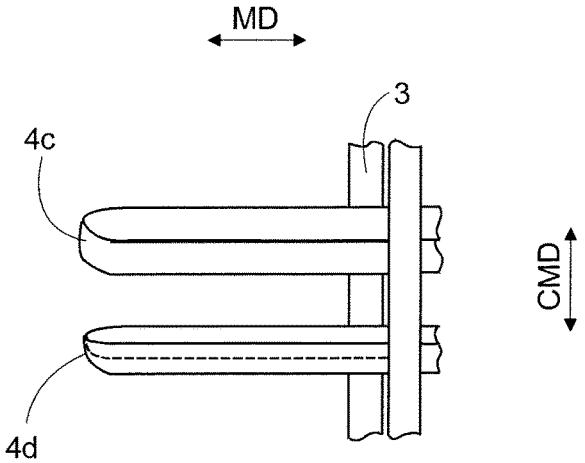

FIG. 6 indicates that the amount of slanting of a seam loop 4*c* may correspond to CMD dimension i.e. width of the MD-yarn. In an alternative solution, slanting of a seam loop 4*d* may correspond to half of the width of the yarn forming the seam loop.

Figure 7:
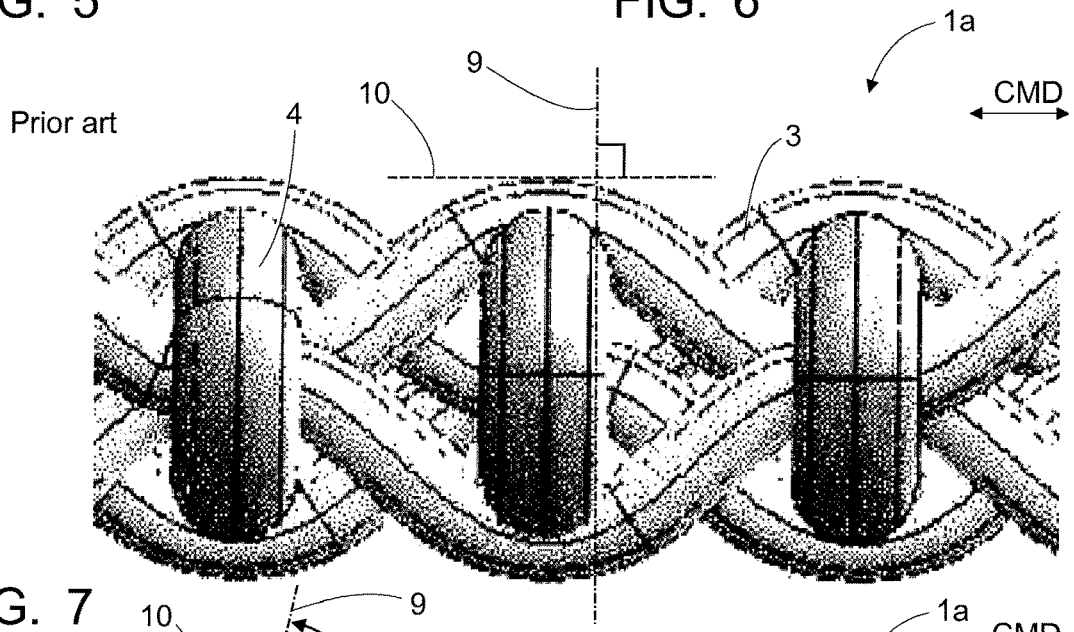
FIG. 7 is a schematic view of a known base fabric seen in the machine direction and showing aligned seam loops.

FIG. 7 discloses a prior art solution concerning an end region of a base fabric. As can be noted, the end region comprises seam loops 4, which are aligned. Then, an imaginary line 9 passing via edge surfaces of the seam loop 4 is perpendicular to an imaginary line 10 passing via an outer surface of the base fabric 1*a*.

Figure 8:
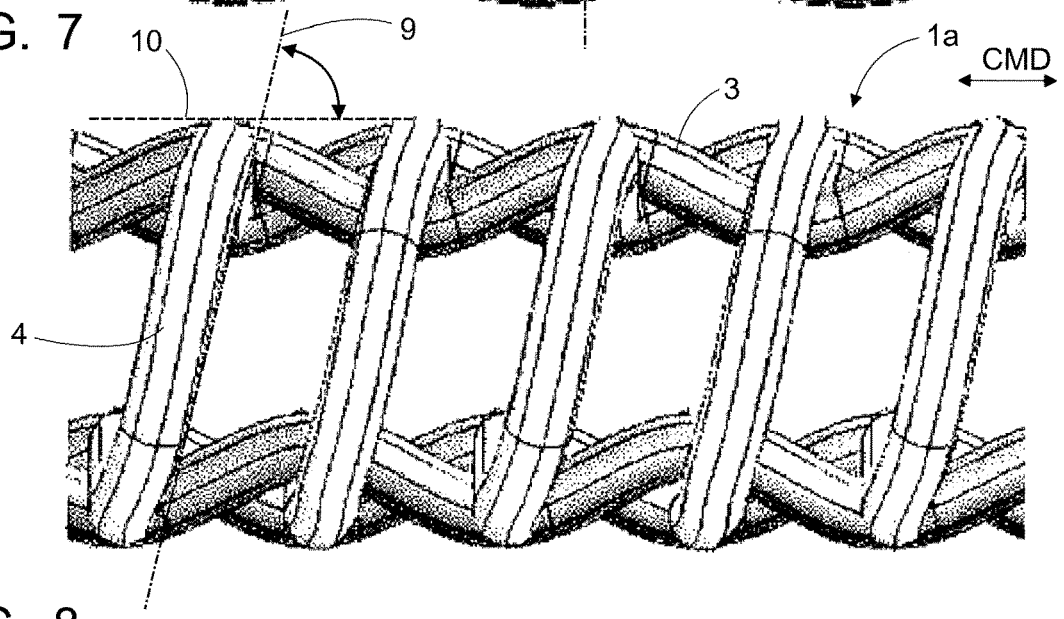
FIG. 8 is a schematic view of base fabric seen in the machine direction and being provided with slanted seam loops.

In FIG. 8 seam loops 4 are slanted. Then, the line 9 clearly shows that the seam loop 4 is slanted relative to the line 10. An angular position between the lines 9 and 10 is definitely not perpendicular.

Figure 9:
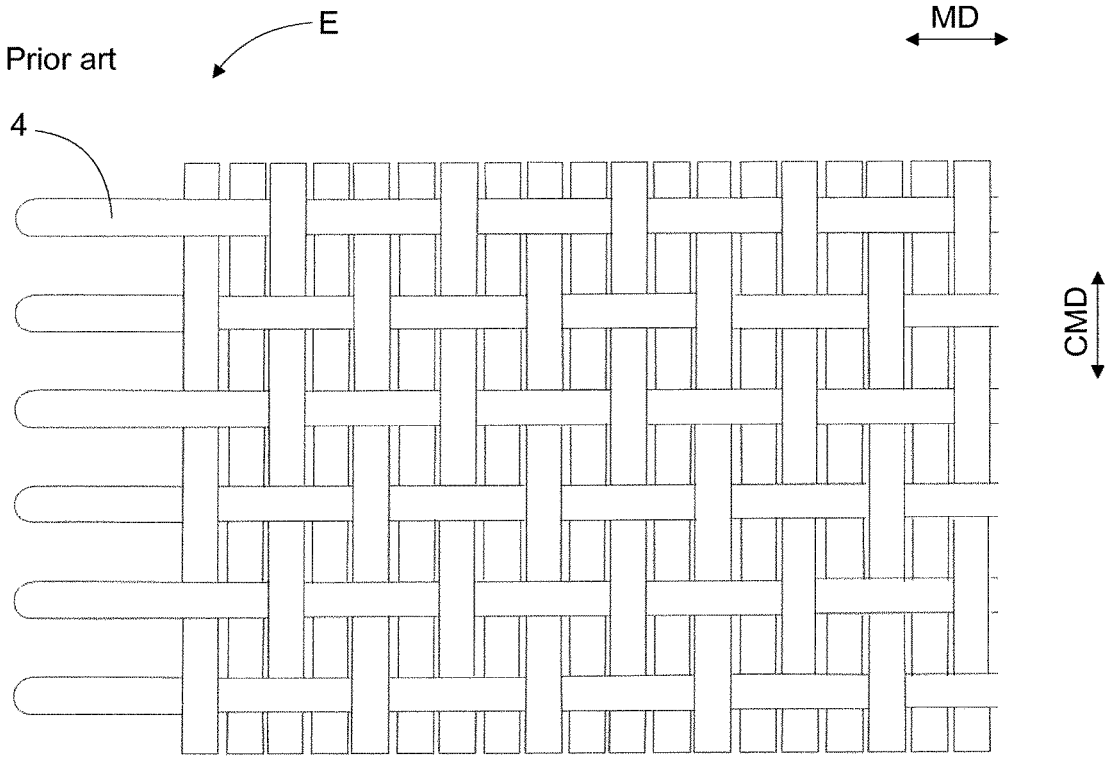
FIG. 9 is a schematic top view of a part of an end region of a prior art base fabric.

FIG. 9 shows from above a conventional basic fabric which is provided with aligned seam loops.

The drawings and the specification associated thereto is merely intended to illustrate the idea of the invention. The details of the invention may vary within the scope of the claims.

The invention claimed is:

1. A base fabric for a press felt, wherein the base fabric is a flat formed structure and comprises:

several machine direction yarns;

several cross machine direction yarns;

a first end region and a second end region, wherein said respective first and second end regions of the base fabric are folded in order to form folded fabric sections and adjacent cross machine direction yarns are removed so that the machine direction yarns, which are also folded, form seam loops at the respective first and second end regions;

transverse bonding sections at proximity of the end regions for bonding the folded fabric sections together;

the seam loops are slanted whereby the folded machine direction yarns forming the seam loops are without alignment at the respective first and second end regions;

the machine direction yarns are twisted relative to their longitudinal axis at the respective first and second end regions in order to allow formation of the slanted seam loops; and there are at least two zones provided with the slanted seam loops, the seam loops in one zone differ from the seam loops in the other zone regarding their slanting direction and/or their angle of slant.

2. The base fabric as claimed in claim 1, wherein adjacent seam loops are partly overlapping at the respective first and second end regions.

3. The base fabric as claimed in claim 1, wherein at least some of the seam loops are partly overlapping with themselves.

4. The base fabric as claimed in claim 1, wherein the flat formed structure has a single layer structure, wherefore after folding the base fabric, the basic fabric comprises a two-layer structure.

5. The base fabric as claimed in claim 1, wherein the bonding sections comprise stitches for bonding each folded section.

6. A press felt for a press section of a paper machine, the press felt comprising a base fabric and at least one batt fibre layer attached to the base fabric;

wherein the base fabric for the press felt is in accordance with claim 1.

7. A method of forming a base fabric with a seam for a press felt, wherein the method comprises:

forming the base fabric of machine direction yarns and cross machine direction yarns by utilizing flat forming technique;

connecting transverse ends of the base fabric together for forming an endless fabric structure;

determining positions of first and second end regions;

removing cross machine direction yarns from the determined respective first and second end regions;

folding the basic fabric against itself whereby folded machine direction yarns form seam loops at the respective first and second end regions; and bonding the folded fabric structure together at proximity of the first and the second end regions;

forcing the seam loops to a predetermined slanted position at the respective first and second end regions; and twisting the machine direction yarns relative to their longitudinal axis at the respective first and second end regions in order to form the slanted seam loops in such a manner that there are at least two zones provided with the slanted seam loops, the seam loops in one zone differ from the seam loops in the other zone regarding their slanting direction and/or their angle of slant.

8. The method as claimed in claim 7, wherein forcing the seam loops to the desired slanted position and distance from each other by means of at least one template piece having guiding surfaces provided with desired angles.

* * * * *